United States Patent [19]

McLaughlin et al.

[11] 4,233,172

[45] * Nov. 11, 1980

[54] LOW PHOSPHATE CONTENT DISHWASHING DETERGENT

[75] Inventors: Robert L. McLaughlin, Wilmette; Donald C. Wood, Des Plaines, both of Ill.

[73] Assignee: DeSoto, Inc., Des Plaines, Ill.

[ * ] Notice: The portion of the term of this patent subsequent to Feb. 5, 1997, has been disclaimed.

[21] Appl. No.: 951,245

[22] Filed: Oct. 13, 1978

Related U.S. Application Data

[63] Continuation-in-part of Ser. No. 872,761, Jan. 27, 1978, which is a continuation-in-part of Ser. No. 737,588, Nov. 1, 1976, abandoned.

[51] Int. Cl.[3] ..... C11D 7/56; C11D 7/54

[52] U.S. Cl. ..... 252/99; 252/135; 252/174.14; 252/DIG. 1; 252/321

[58] Field of Search ..... 252/99, 135, 89 R, DIG. 1, 252/358, 321

[56] References Cited

U.S. PATENT DOCUMENTS

| | | | |
|---|---|---|---|
| 3,549,539 | 12/1970 | Mallows | 252/89 X |
| 3,899,436 | 8/1975 | Copeland et al. | 252/135 X |
| 4,049,586 | 9/1977 | Collier | 252/135 X |

*Primary Examiner*—Mayer Weinblatt

*Attorney, Agent, or Firm*—Dressler, Goldsmith, Shore, Sutker & Milnamow, Ltd.

[57] ABSTRACT

A dry powder detergent composition suitable for machine dishwashing and which contains a low-phosphate content of from about 10 to about 20 weight percent utilizes, as the essential combination of components, an alkali metal tripolyphosphate or an alkali metal hexametaphosphate, an appropriate proportion of an alkali metal carbonate, and a mixture of a high-foaming nonionic surfactant with a foam reducing agent. The surfactant is preferably liquid and is sorbed on solid constituents of the composition to provide a detergent which exhibits superior performance in hard water notwithstanding the relatively low phosphate content of the composition. The nonionic surfactant mixture preferably further comprises an oil-soluble, nonionic surfactant.

13 Claims, No Drawings

LOW PHOSPHATE CONTENT DISHWASHING DETERGENT

This application is a continuation-in-part of our prior application Ser. No. 872,761 filed Jan. 27, 1978 which, in turn, is a continuation-in-part of our prior application Ser. No. 737,588 filed Nov. 1, 1976, now abandoned.

BACKGROUND OF THE INVENTION

This invention relates to machine dishwashing compositions of relatively low phosphorus content in which superior performance is achieved using mixtures containing high-foaming nonionic surfactants in the absence of alkali metal silicates.

Synthetic detergents capable of performing a wide variety of household and industrial cleaning operations are known in the art and are formulated for optimized performance under the contemplated end use conditions. For example, machine dishwashing detergents are formulated for use in appliances in which a moving, high-velocity water spray is utilized for cleaning tableware and cooking utensils. The performance requirements for such a detergent differ substantially from the requirements for a laundry or hand-dishwashing detergent and include very low sudsing. effective rinsing to avoid residual deposits, thorough removal of food protein particles which can cause spot formation during drying, and sequestration of calcium and magnesium ions usually present in the water supply. Damage to the dishes being washed, such as etching of glassware, must also be avoided.

To meet the foregoing performance requirements, typical machine dishwashing detergents contain a relatively small amount of a nonionic surfactant, a small amount of a chlorine or oxygen-releasing bleach, a relatively large amount of a phosphate-type builder or sequestrant, and moderate to relatively large amounts of auxiliary sources of alkalinity, such as alkali metal carbonates and alkali metal silicates, which enhance the cleaning action and minimize corrosion. However, from the standpoint of environmental considerations, the presence of large amounts of phosphates or similar phosphorus-containing compounds in machine dishwashing detergents is very undesirable, and it is the objective of this invention to provide a practical powder dishwashing composition containing only about 10 to about 20 weight percent of phosphorus-containing compounds (instead of the 25 to 50 weight percent normally needed) while retaining superior washing action and without harming the dishes being washed.

SUMMARY OF THE INVENTION

The present invention contemplates a machine dishwashing detergent composition of a relatively low phosphate content that is nevertheless effective in hard water (i.e., having a water hardness up to about 275 to 300 parts per million), and that is highly effective in removing food residues from tableware and cooking utensils. The present detergent composition also minimizes spotting and is safe for the items being washed.

The detergent composition of this invention is a dry powder that, on a weight basis, contains the following essential combination of active ingredients:

a phosphorus-containing compound in an amount of about 10 to about 20 weight percent and which can be an alkali metal tripolyphosphate or an alkali metal hexametaphosphate;

at least 8 weight percent of carbonate compound selected from an alkali metal carbonate, bicarbonate or sesquicarbonate providing a carbonate-to-phosphate weight ratio of about 0.8:1 to about 1.3:1, but preferably not more than about 1.2:1, a high-foaming nonionic surfactant in an amount of at least about 1 weight percent of said composition, and a defoaming agent therefor. The nonionic surfactant is preferably a liquid which is taken up or sorbed on the solid constituents of the detergent composition.

The composition, particularly in its commercial form, also may contain a water-soluble oxidizing bleach in an amount which supplies about 0.3 to about 3 weight percent of the composition of an oxidizing component (i.e., chlorine or oxygen), and a water-soluble filler such as sodium sulfate or the like.

As will be readily apparent from the relative amounts of the active ingredients in the aforesaid essential combination, the amount of phosphorus present in the compositions of the present invention is less than the amount generally present in the prior art machine dishwashing compositions. The present detergent composition provides surprisingly effective washing performance even when the phosphorus content is about one-half of the amount generally present in prior art machine dishwashing compositions, or less.

The relatively low-phosphate detergent composition of the present invention is made possible by a combination of factors including the use of high-foaming nonionic, water-soluble surfactant which provides effective cleaning performance, even in relatively hard water. High-foaming nonionics are used together with a foam reducing agent, since machine dishwashers cannot accept high-foaming compositions. The high-foaming nonionic, water-soluble surfactant can be an ethoxylated hydrophobic monohydric compound which is preferably a long chain alkanol containing at least about 7 moles of ethylene oxide per mole of monohydric compound which is preferably an alkanol, but which may be a fatty acid alkanol amide or an octyl or nonyl phenol. Optionally, an oil-soluble, liquid nonionic surfactant which is a hydrophobic long chain alkanol ethoxylated to contain about 1 to about 5 moles of ethylene oxide per mole of alkanol can be present in the blend to provide wetting for fatty soils and thereby improve the detergency.

All of the surfactants are preferably liquids which are sorbed, i.e., absorbed and/or absorbed, on the solid constituents of the detergent formulation.

DESCRIPTION OF PREFERRED EMBODIMENTS

The relatively small amount of the phosphorus-containing compound that is present in the present formulations serves as an inorganic builder, i.e., a compound which sequesters or suspends polyvalent metal ions (usually $Ca^{+2}$ and $Mg^{+2}$) present in substantial quantities in the so-called hard water supplies, so that these metal ions do not combine either with the components that are present or with the various soils such as lipid residues or carbohydrates to form less soluble residues which tend to adhere tenaciously to the surfaces being cleaned. While many builders are known in the art and are utilized in detergent compositions, in the present formulations the desired builders are certain phosphorus compounds, i.e., an alkali metal tripolyphosphate, such as sodium tripolyphosphate or potassium tripolyphosphate, or an alkali metal hexametaphosphate, such as sodium hexametaphosphate or potassium hexametaphosphate. Based on a composition containing 100 total parts, the amount of the phosphorus-containing compound should not exceed about 20 parts by weight, and can be as low as about 10 parts by weight, depending on the water hardness that is likely to be encountered in a particular region. Preferably the phosphorus-containing compound is present in an amount of about 17 parts by weight which is about half the amount usually used, e.g., about 35 parts.

The alkali metal carbonate, e.g., sodium carbonate or potassium carbonate, is present in an amount of at least 8 parts providing a carbonate-to-phosphate weight ratio of from about 0.8:1 to about 1.3:1, preferably up to about 1.2:1. The corresponding bicarbonates or sesquicarbonates may also be used, if desired. When too little carbonate is used to balance the phosphate, then the composition tends to etch glass. When too much carbonate is used, then spotting is observed. The difficulty of excessive carbonate content arises out of the fact that the proportion of phosphate is below the minimum of 25 parts which is usually insisted upon. The problem of soft water etching of glass is minimized herein by the low phosphate content. The minimum carbonate content also is required to maintain needed alkalinity.

During formulation, the carbonate may be added to the detergent composition in anhydrous form as well as in hydrated or partially hydrated form; however, the aforesaid amounts are based on anhydrous carbonate, any water present being ignored in calculating the proportions. The bicarbonate or sesquicarbonate can be substituted for the carbonate on an equi-weight basis.

The alkali metal carbonate provides, when the phosphate content is diminished, a mildly alkaline detergent solution within the dishwasher, and in combination with the other ingredients, provides the desired detergency. It also serves as a carrier for the liquid nonionic surfactant blend.

In general, the higher the phosphorus content of the detergent composition, the more corrosive is the composition, so the compositions of this invention have the advantage of being less corrosive. The alkali metal silicates normally present to minimize corrosion are unnecessary herein and it is a feature of this invention to omit such silicates and to obtain excellent washing action without their presence. It might be appreciated that one aspect of corrosion resistance is the fact that modern washing machines are less subject to corrosion than those sold previously. However, the compositions of this invention avoid insolubles and the etching of glass in the absence of added silicates, and this presents an economic advantage.

The nature of the nonionic surfactants which make up the surfactant mixture is important. At least one relatively high-foaming, water-soluble, nonionic surfactant must be present together with an agent which reduces foam.

Foam reducing agents are themselves well known and are subject to wide variation. Any food grade foam reducing agent can be used, including aqueous silicone emulsions, hydrophobic powders such as finely divided silica or tallow fatty acids, or even low-foaming nonionic surfactants which are soluble in water at room temperature.

The low-foaming nonionic surfactant which can be used to reduce foam is a water-soluble oxyalkylene block copolymer which is a polyol containing at least some terminal secondary hydroxyl groups. The hydrophobic element of the low-foaming nonionic surfactant preferably is a polyoxypropylene chain which terminates the block copolymer, and the hydrophilic element thereof preferably is a polyoxyethylene chain which constitutes an interior portion of the block copolymer. The low-foaming nonionic surfactants most suitable for the present purposes are the water-soluble polyoxypropylene-polyoxyethylene condensates having an average molecular weight of about 2000 to about 4000, and exhibit a foam height of about 5 millimeters, or less, when a 0.1 weight percent aqueous solution thereof at about 120° F. is sprayed through an orifice for 10 minutes in accordance with a test procedure described in greater detail hereinbelow. These condensates usually contain from about 2 to about 9 mols of propylene oxide per molecule of polyoxyethylene in the hydrophobic core.

Typical illustrative low-foaming nonionic surfactants within the foregoing category are the water-soluble, liquid polyols having terminal secondary hydroxyl groups and a relatively low cloud point. These polyols are commercially available from BASF Wyandotte Corporation under the designation "Pluronic R". Particularly preferred is the water-soluble polyol having a molecular weight of about 3120 and cloud point of about 33° C. in a 1 percent aqueous solution, commercially available under the designation "Pluronic 25R2".

Also suitable are the low-foaming liquid polyols derived from condensation products of a hydrophobic polyoxyalkylene polymer with hydrophilic chains that are mixed polyoxyethylene-polyoxypropylene chains. Liquid polyols of this particular type are disclosed in U.S. Pat. No. 3,101,374 to Patton, Jr.

The high-foaming, nonionic surfactant that is present in the surfactant blend contemplated by the present invention preferably is a water-soluble, ethoxylated monohydric compound which is preferably a long chain alkanol to provide biodegradability. Water-solubility usually requires at least about 7 moles of ethylene oxide per mole of monohydric compound. The term "about 7" is intended to embrace the water-soluble ethoxylates, and below about 6.5 moles of ethylene oxide per mol of alcohol induces significant water-insolubility. The monohydric portion of the surfactant molecule provides the hydrophobic base of the surfactant and usually employs an alkanol which contains at least about 8 carbon atoms, preferably about 12 to about 18 carbon atoms. With the least hydrophobic base of about 8 carbon atoms, about 6.5 moles of ethylene oxide will provide the needed water solubility.

The degree of ethoxylation can range up to about 45 moles of ethylene oxide per mole of alcohol, or higher, which enables solid surfactants to be provided, but liquids are preferred since these are absorbed and cannot segregate. Preferably the high-foaming, nonionic surfactant is an ethoxylated mixture of biodegradable primary linear $C_{12-15}$ alkanols having about 7 to about 9 moles of ethylene oxide per mole of alkanol.

Typical illustrative high-foaming, nonionic surfactants are the water-soluble, liquid ethoxylated alcohols commercially available from Shell Chemical Company under the designation "Neodol 25-7" and "Neodol 25-9" which are ethoxylated mixtures of primary linear $C_{12-15}$ alkanols containing, respectively, about 7 and about 9 moles of ethylene oxide per mole of alkanol.

Also suitable as high-foaming, nonionic surfactants for the purposes of the present invention, are the fatty acid alkanol amides such as the diethanolamide condensates of fatty acids. Saturated fatty acids having 10 to 18 carbon atoms can be condensed with diethanolamine in an amine-to-acid ratio of about 2:1 to produce the surfactants. Typical of the surfactants of the foregoing type is a coconut oil diethanol amide commercially available under the designation "Clindrol 200 CGN" and "Ardet DC".

To facilitate the handling of oily and greasy substances that are encountered in dishwashing operations, optionally an oil-soluble, liquid, nonionic surfactant that is an oil-soluble, hydrophobic alkanol having a relatively low degree of ethoxylation can be incorporated into the surfactant blend. The alkanol portion of the surfactant molecule is usually an alkanol which contains about 8 to about 18 carbon atoms, and the degree of ethoxylation can be about 1 to about 5 moles of ethylene oxide per mole of alkanol, preferably 2–3.5 moles of ethylene oxide per mole of alkanol containing 10–15 carbon atoms. About 1–2 moles of ethylene oxide are sufficient for the shortest chain alkanols and about 3.5–5 moles of ethylene oxide are required for the longest chain alkanols.

The oil-soluble monionic surfactant can be used in a weight ratio of 9:1 to 1:9, preferably 3:1 to 1:3, with respect to the high-foaming, nonionic surfactants.

Typical illustrative oil-soluble liquid, nonionic surfactants are the ethoxylated primary linear alcohols commercially available from Shell Chemical Company under the designation "Neodol 25-3" and "Neodol 25-5", and which are derived from a mixture of ethoxylated $C_{12-15}$ primary linear alcohols containing, respectively, 3 moles and 5 moles of ethylene oxide per mole of alcohol. Neodol 25-3 is particularly preferred.

The relative amount of the low-foaming, nonionic surfactant that is present in the surfactant blend to reduce foaming can vary considerably. The weight ratio of the low-foaming, nonionic surfactant to the balance of nonionic surfactant in the blend can range from about 1.5:1 to about 9:1, and preferably about 2:1 to about 4:1. Particularly preferred is a weight ratio of about 3:1.

Other foam-reducing agents can be used in very small amounts. Thus, as little as 0.05 part of an emulsified silicone is effective. The point is that foam-reducing agents and their proportion of use to enable high-foaming, nonionic surfactants to be used, are themselves well known, this invention being directed to the problem of how to use these surfactants effectively in a low-phosphate content machine dishwashing powder.

As pointed out hereinabove, the high-foaming, nonionic surfactant constitutes at least about 1 part, preferably at least 2 parts by weight of the detergent composition. Preferably the total nonionic surfactant content is about 2 to about 10 parts by weight, more preferably in an amount of about 2 to about 8 parts by weight.

The characterization "low-foaming" as used herein and in the appended claims means a foam height of about 10 millimeters or less generated in 10 minutes when a 0.1 weight percent aqueous solution of the surfactant at 120° F. (49° C.) is subjected to a test procedure whereby 10 liters of the solution are placed in a PYREX jar (10" dia. × 10" high) equipped with a propeller-type stirrer, knife-blade heaters, a thermoregulator and a thermometer. A small centrifugal pump is arranged to circulate the solution contained in this jar through a calibrated glass flow meter to a jet orifice prepared from the base of a No. 20 Becton, Dickinson and Company hypodermic needle by enlarging the hole in the base with a No. 56 twist drill. The jet orifice is mounted coaxially inside a PYREX glass tube (51 mm. × 910 mm.) which is placed vertically in the solution. The jet is positioned so that it is 600 mm. above the surface of the solution in the jar, and the PYREX tube is arranged to project 210 mm. below the surface of the solution.

The solution is brought to temperature by means of the knife blade heater and maintained at 120° F. means of a thermoregulator. The centrifugal pump is started and a flow of 400 ml. of solution per minute is metered through the jet. The flow is adjusted by bypassing part of the stream back into the PYREX jar before passing through the flow meter. The solution passing through the jet is directed against the wall of the vertical tube while the flow is adjusted and the temperature equilibrated in order to prevent foaming prior to the actual determination. The jet is then arranged to pass the solution coaxially downward through the tube without touching the tube walls and to impinge upon the surface of the solution located in the PYREX tube. Timing is started from the instant the solution impinges on the liquid surface and the foam height is read at the end of 10 minutes. The foam height readings are obtained from a calibration on the outside of the PYREX tube with the zero mark being at the surface of the solution.

The characterization "high-foaming" as used herein and in the appended claims means a foam height greater than about 10 millimeters generated in the foregoing test.

A bleaching agent which is a water-soluble oxidizing compound can also also be present in the detergent compositions of this invention. The bleaching agent can be based on a hypochlorite species which releases chlorine as the oxidizing component or on a peroxygen species which releases oxygen as the oxidizing component. Illustrative chlorine-releasing bleaches are sodium dichloroisocyanurate, potassium dichloroisocyanurate, trichloriisocyanuric acid, sodium hypochlorite, lithium hypochlorite, chlorinated trisodium phosphate, 1,3-dichloro-5,5-dimethyl hydantoin, and the like. Oxygen-releasing bleaches are illustrated by sodium perborate, sodium persulfate, potassium perborate and the like.

The water-soluble oxidizing bleach can be present in the composition in an amount sufficient to supply about 0.3 to about 3 parts by weight of the desired oxidizing component, i.e., the active chlorine or active oxygen.

An inert particulate filler which is water-soluble but does not precipitate calcium or magnesium ions at use concentrations usually makes up the remainder of the present detergent compositions. Suitable for this purpose are organic or inorganic compounds such as urea, sodium sulfate, sodium chloride, potassium chloride and the like. Generally, about 40 to about 70 parts by weight of the filler are present in the detergent compositions.

If desired, minor amounts of various other adjuvants or additives, e.g., perfumes, coloring agents, moisture absorbing agents, flow control agents, foam depressants, soil suspending agents, soil anti-redeposition agents, and the like, can be incorporated into the present detergent formulations.

The detergent compositions of the present invention can be compounded from the ingredients discussed hereinabove in any convenient manner. For example, powdered phosphorus-containing compound and powdered alkali metal carbonate can be thoroughly mixed to produce admixture, the blend of liquid nonionic surfactants is then substantially uniformly mixed in with the produced admixture so as to produce a free-flowing product, and subsequently the filler is blended in to produce a substantially uniform final product.

Preferred dry powder, low-phosphate detergent compositions embodying the present invention are compounded using about 10 to about 20 weight percent sodium tripolyphosphate; about 8 to about 24 weight percent sodium carbonate; about 1 to about 5 weight percent of a water-soluble ethoxylated alkanol high-foaming, nonionic surfactant containing at least about 7 moles of ethylene oxide per mole of alcohol, and a foam-reducing agent threfore, about 0.7 to about 1.5 weight percent sodium dichlorocyanurate; up to about 3 weight percent of oil-soluble nonionic surfactant which is ethoxylated primary linear $C_{12-15}$ alkanols containing about 2.0 to about 3.5 moles of ethylene oxide per mol of alkanol, and sodium sulfate as the balance of the composition.

The present invention is illustrated by the following examples.

EXAMPLE I: LOW TRIPOLYPHOSPHATE DISHWASHING COMPOSITION

A dry powder, low-phosphate detergent composition was prepared by blending together the following ingredients:

| | | |
|---|---|---|
| sodium tripolyphosphate | | 17 wt. % |
| sodium carbonate | | 20 wt. % |
| bleach (57% active Cl)[1] | | 1.2 wt. % |
| blend of water-soluble, liquid nonionic surfactants | | |
| low-foaming surfactant[2] | 3 wt. % | |
| high-foaming surfactant[3] | 1 wt. % | |
| | | 4 wt. % |
| sodium sulfate | | 57.8 wt. % |

[1]sodium dichloroisocyanurate
[2]Pluronic 25R2
[3]Neodol 25-7

The foregoing composition was used in a commercial dishwashing machine in an amount providing a detergent concentration in an aqueous wash solution of about 0.25 weight percent. The water used to make up the wash solution had a hardness of about 140 ppm. The obtained wash solution provided effective dishwashing without excessive foam formation and without etching of glassware.

EXAMPLE II: LOW TRIPOLYPHOSPHATE DISHWASHING COMPOSITION CONTAINING OIL-SOLUBLE SURFACTANT

A dry powder, low-phosphate detergent composition was prepared by blending together the following ingredients:

| | | |
|---|---|---|
| sodium tripolyphosphate | | 17 wt. % |
| sodium carbonate | | 20 wt. % |
| bleach (57% active Cl)[1] | | 1.2 wt. % |
| blend of water-soluble, liquid nonionic surfactants | | |
| oil-soluble surfactant[2] | 1 wt. % | 3 wt. % |
| high-foaming surfactant[3] | 2 wt. % | |
| foam reducing agent[4] (30% water emulsion) | | 0.2 wt. % |
| sodium sulfate | | 58.6 wt. % |

[1]sodium dichloroisocyanurate
[2]Neodol 25-3
[3]Neodol 25-7
[4]Union Carbide Corporation SA6 30 - 30% polymethyl silicone emulsion in water The foregoing composition was used in a commercial dishwashing machine in an amount providing a detergent concentration in an aqueous wash solution of about 0.25 weight percent. The water used to make up the wash solution had a hardness of about 140 ppm. The obtained wash solution provided an even more effective dishwashing than the composition of Example I without excessive foam formation.

We claim:

1. A dry powder, low-phosphate machine dishwashing composition which consists essentially of:

about 10 to about 20 weight percent of a phosphorus-containing compound selected from the group consisting of an alkali metal tripolyphosphate and an alkali metal hexametaphosphate;

at least 8 weight percent of carbonate compounds selected from the group consisting of alkali metal carbonate, bicarbonate or sesquicarbonate, providing a carbonate-to-phosphate weight ratio of about 0.8:1 to about 1.3:1; and at least about 1 up to about 10 weight percent of said composition of a water-soluble high-foaming nonionic surfactant which is an ethoxylated monohydric compound containing at least about 7 moles of ethylene oxide per mol of monohydric compound, and a foam reducing agent therefor.

2. The detergent composition in accordance with claim 1 wherein said composition additionally contains a liquid surfactant which is an oil-soluble, hydrophobic ethoxylated alkanol containing about 8 to about 18 carbon atoms and about 1 to about 5 moles of ethylene oxide per mole of alkanol, said oil-soluble surfactant being present in a weight ratio with respect to said high-foaming nonionic surfactant of 9:1 to 1:9.

3. The detergent composition in accordance with claim 1 wherein said high-foaming nonionic surfactant is present in an amount of at least about 2 weight percent of the composition.

4. The detergent composition in accordance with claim 1 wherein said phosphorus-containing compound is sodium tripolyphosphate.

5. The detergent composition in accordance with claim 4 wherein said carbonate is sodium carbonate and the carbonate-to-phosphate weight ratio is about 0.8:1 to about 1.2:1.

6. The detergent composition in accordance with claim 1 wherein said high-forming nonionic surfactant is a water-soluble ethoxylate of primary linear $C_{12-15}$ alkanols containing about 7 to about 9 moles of ethylene oxide per mole of alcohol.

7. The detergent composition in accordance with claim 6 wherein said composition includes a mixture of oil-soluble ethoxylated primary linear $C_{12-15}$ alkanols containing about 2 to about 3.5 moles of ethylene oxide per mole of alkanol in a weight ratio with respect to said high-foaming nonionic surfactant of 3:1 to 1:3.

8. The detergent composition in accordance with claim 6 wherein the composition includes, as the foam-reducing agent, a water-soluble propylene oxide block copolymer on a polyoxyethylene core, the copolymer having an average molecular weight of about 2000 to about 4000 and containing from about 2 to about 9 moles of propylene oxide per molecule of polyoxyethylene.

9. The detergent composition in accordance with claim 1 which additionally contains a water-soluble oxidizing bleach in an amount supplying about 0.3 to about 3 parts by weight of the composition of an oxidizing component selected from the group consisting of chlorine and oxygen.

10. The detergent composition in accordance with claim 9 which additionally contains sodium sulfate as water-soluble filler.

11. The detergent composition in accordance with claim 9 in which said composition contains about 0.7 to about 1.5 weight percent sodium dichloroisocyanurate; and sodium sulfate constitutes the balance of the composition.

12. The detergent composition in accordance with claim 1 in which said high-foaming nonionic surfactant is a liquid water-soluble ethoxylate of alkanol containing from 8 to 18 carbon atoms with at least about 7 moles of ethylene oxide per mol of alkanol, said liquid surfactant being absorbed on the solid constituents of the composition.

13. A dry powder, low-phosphate machine dishwashing detergent composition in accordance with claim 12 which consists essentially of:

about 17 weight percent sodium tripolyphosphate;

about 20 weight percent sodium carbonate;

about 1 to about 5 weight percent of water-soluble, liquid, high-foaming nonionic ethoxylated primary linear $C_{12-15}$ alkanols containing about 7 to about 9 moles of ethylene oxide per mole of alkanol, and a foam-reducing agent therefor.

about 0.7 to about 1.5 weight percent sodium dichloroisocyanurate;

up to about 3 weight percent of oil-soluble nonionic surfactant which is ethoxylated primary linear $C_{12-15}$ alkanols containing about 2.0 to about 3.5 moles of ethylene oxide per mol of alkanol; and sodium sulfate as the balance of the composition.

* * * * *